United States Patent [19]

Galiasso et al.

[11] Patent Number: 4,626,340

[45] Date of Patent: Dec. 2, 1986

[54] PROCESS FOR THE CONVERSION OF HEAVY HYDROCARBON FEEDSTOCKS CHARACTERIZED BY HIGH MOLECULAR WEIGHT, LOW REACTIVITY AND HIGH METAL CONTENTS

[75] Inventors: Roberto E. Galiasso, San Antonio de Los Altos; Beatriz R. Arias; Lino Caprioli, both of Caracas; Juan Garcia, San Antonio de Los Altos; Humberto Kum, Los Teques, all of Venezuela

[73] Assignee: Intevep, S.A., Caracas, Venezuela

[21] Appl. No.: 780,589

[22] Filed: Sep. 26, 1985

[51] Int. Cl.[4] ..... C10G 69/06; C10G 69/10

[52] U.S. Cl. ..... 208/89; 208/61; 208/74; 208/107; 208/112; 208/216 PP; 208/251 H

[58] Field of Search ..... 208/68, 89, 251 H, 107, 208/216 PP, 112, 58, 61, 59, 72, 74, 75; 502/309

[56] References Cited

U.S. PATENT DOCUMENTS

| | | | |
|---|---|---|---|
| 3,730,875 | 5/1973 | Gleim et al. | 208/61 |
| 3,775,293 | 11/1973 | Watkins | 208/61 |
| 4,176,048 | 11/1979 | Corns et al. | 208/59 |
| 4,206,036 | 6/1980 | Takeuchi et al. | 208/89 |
| 4,366,047 | 12/1982 | Winter et al. | 208/107 |
| 4,368,113 | 1/1983 | Winter et al. | 208/89 |
| 4,376,695 | 3/1983 | Belinko et al. | 208/58 |
| 4,421,633 | 12/1983 | Shih et al. | 208/216 PP |
| 4,422,960 | 12/1983 | Shiroto et al. | 502/309 |
| 4,451,354 | 5/1984 | Stuntz | 208/89 |
| 4,490,483 | 12/1984 | Vogel et al. | 502/309 |
| 4,511,458 | 4/1985 | Billon et al. | 208/89 |
| 4,520,128 | 5/1985 | Morales et al. | 208/112 |
| 4,525,472 | 6/1985 | Morales et al. | 208/216 PP |
| 4,572,778 | 2/1986 | Ward | 208/216 PP |

*Primary Examiner*—Andrew H. Metz
*Assistant Examiner*—Anthony McFarlane
*Attorney, Agent, or Firm*—Bachman & LaPointe

[57] ABSTRACT

A process for the conversion of heavy hydrocarbon feedstocks which are characterized by high molecular weight, low reactivity and high metal contents comprising feeding the feedstock to a hydrodemetallization zone where the feedstock is contacted with hydrogen and a catalyst capable of demetallizing organometallic complexes of high molecular weight and cracking resistance, thereafter removing the effluent from the demetallization zone and feeding same to the thermal cracking zone where the effluent is contacted with hydrogen and thereafter feeding the product from the cracking zone to a hydrocarbon conversion zone where the product is contacted with hydrogen and a catalyst capable of cracking molecules of high cracking resistance.

7 Claims, 3 Drawing Figures

GPC OF ASPHALTHENES

CONVERSION OF FRACTION 1 : $\frac{\text{MASS IN FEED} - \text{MASS IN PRODUCT}}{\text{MASS IN FEED}}$

GPC OF FEED AND PRODUCT OF REACTION

PROCESS FOR THE CONVERSION OF HEAVY HYDROCARBON FEEDSTOCKS CHARACTERIZED BY HIGH MOLECULAR WEIGHT, LOW REACTIVITY AND HIGH METAL CONTENTS

BACKGROUND OF THE INVENTION

The present invention relates to a process for the hydroconversion of heavy hydrocarbon feedstocks and, more particularly, a three-stage process employing upstream flow reactors with catalysts in the first and third stages.

Processes for the thermal and catalytic hydroconversion of hydrocarbon feeds are well known. The term hydroconversion as used herein means the conversion of residues, asphaltenes and resins remaining from atmospheric or vacuum distillation of conventional and/or non-conventional crude oils into lesser boiling point distillated products. When treating residues which have a disproportionate amount of contaminant elements such as vanadium, nickel, nitrogen and sulfur, catalysts are often employed in the hydroconversion process. These catalysts, which are generally very expensive, have a relatively short life when treating such residues.

U.S. Pat. No. 4,434,045 to Vernon et al. discloses a process for hydrocracking residuals in the presence of a hydrogen donor solvent. U.S. Pat. No. 4,447,313 to Gorring et al. relates to a process for hydrocracking residuals wherein a deasphalting stage precedes the hydrocracking stage so that most of the heavy fractions containing the majority of the contaminants are removed thereby leaving a considerable amount of residual without conversion. U.S. Pat. No. 4,431,526 to Simpson et al. is drawn to a process for the hydrotreatment of hydrocarbons particularly for the hydrodesulfurization and hydrodemetallization wherein the process is performed in two steps using average sized catalysts of different pore size. Finally, U.S. Pat. No. 4,431,525 to Hensley, Jr. et al. teaches a process for the hydrotreatment of hydrocarbon streams containing metals, asphaltenes, nitrogen compounds and sulfur wherein the process comprises three different steps, each step employing a catalyst having different physical and chemical properties. While the foregoing U.S. patents discuss the problems faced when treating heavy hydrocarbon feeds, none of the processes teach the specific process of the present invention employing the specific equipment as set forth in the present invention. Generally the prior art processes fail to extend the life of the catalysts to any significant amount.

Naturally it would be highly desirable to develop a process for the hydroconversion of heavy hydrocarbon feedstocks into usable distillates while at the same time improving the life of the catalysts employed in the process.

Accordingly, it is a principal object of the present invention to develop a process for the conversion of heavy hydrocarbon feedstocks characterized by high molecular weight, low reactivity and high metal contents.

It is a particular object of the present invention to provide a multi-step process for the conversion of heavy feedstocks wherein upstream flow reactors with catalysts are employed in the first and third stages.

It is a particular object of the present invention to provide a process as aforesaid wherein the intermediate stage between the first and third stages comprises a down flow thermal cracking step.

It is a still further object of the present invention to provide a process as aforesaid wherein the catalyst employed in the first stage of the process is capable of demetallizing organometallic complexes of high molecular weight and cracking resistance and a catalyst in the third stage which is capable of cracking molecules of high cracking resistance.

Further objects and advantages of the present invention will appear hereinbelow.

SUMMARY OF THE INVENTION

In accordance with the present invention, the foregoing objects and advantages are readily obtained.

The present invention is drawn to a process for the conversion of heavy hydrocarbon feedstocks characterized by high molecular weight, low reactivity and high metal contents. In accordance with the process of the present invention a multi-stage process is employed wherein a heavy hydrocarbon feedstock is fed to a first stage comprising a hydrodemetallization zone wherein the feedstock is contacted with hydrogen and a catalyst capable of demetallizing organometallic complexes of high molecular weight and cracking resistance. Thereafter, the effluent from the first stage is removed from the demetallization zone and fed to a thermal cracking zone wherein the effluent is contacted with hydrogen. The product from the cracking zone is then fed to a hydrocarbon conversion zone where the product is contacted with hydrogen and a catalyst capable of cracking molecules of high cracking resistance. In accordance with the particular feature of the present invention, the reactors used in the hydrodemetallization zone and the hydrocarbon conversion zone are upstream flow reactors which, it has been found, give superior results in treating the heavy hydrocarbon feedstocks.

Further advantages of the present invention will appear hereinbelow.

DETAILED DESCRIPTION

Figure 1:
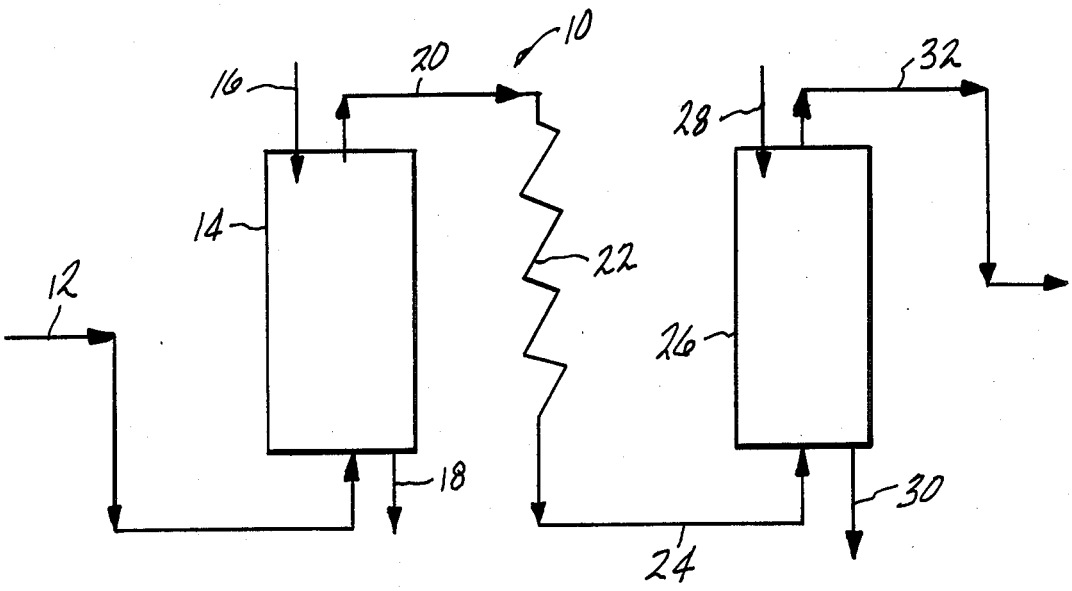
FIG. 1 is a schematic flow diagram illustrating the process of the present invention comprising a hydrodemetallization step, a cracking step and a hydroconversion step.

With reference to FIG. 1, the process 10 of the present invention will be described in detail.

A feedstock characterized by high molecular weight, low reactivity and high metal contents is fed via line 12 to a hydrodemetallization zone 14. In accordance with the present invention, the heavy hydrocarbon feedstock is characterized by the following composition and properties:

| | |
|---|---|
| Gravity, °API | 0–15 |
| KV at 210° F., cst | 5000–70,000 |
| Vanadium, wt. ppm | 400–800 |
| Nickel, wt. ppm | 50–150 |
| Asphaltenes, % wt. | 10–25 |

-continued

| | |
|---|---|
| Conradson Carbon, % wt. | 10 |
| 500° C. + Residue Content, % wt. | 50% |
| Fraction 1% by weight | 20% |

The 500° C.+ residue has a low reactivity characterized by a molecular weight distribution from 400 to 100,000 as measured by gel chromatography at room temperature and a pressure from 2 to 10 atm, wherein 40% by weight of the vanadium distribution of said residue is concentrated in the fraction having a molecular weight from 20,000 to 100,000. The reactor in the hydrodemetallization zone is a catalytic reactor of the fixed bed type characterized by a rising upstream flow. In the hydrodemetallization zone the feedstock is contacted with hydrogen and a catalyst capable of demetallizing organometallic complexes of high molecular weight and cracking resistance under the following operating conditions: a temperature of from 380° to 440° C., a pressure of from 120 to 230 atm, a space velocity of from 0.1 to 1.0 l/hr and a hydrogen-hydrocarbon ratio of from 300 to 5000 Nlt/lt. In accordance with the particular features of the present invention, the catalyst provided in the hydrodemetallization zone, as noted above, is a catalyst capable of demetallizing organometallic complexes of high molecular weight and cracking resistance. The hydrodemetallization catalyst in accordance with the present invention has a molybdenum surface concentration of from 4.0 to 8.0% by weight, a titanium surface concentration of from 0.15 to 1.2% by weight, a nickel surface concentration of from 2.0 to 5.0% by weight, an aluminum surface concentration of from 50.0 to 80.0% by weight and a sulfur surface concentration of from 2.0 to 10.0%, as measured by photoelectron spectroscopy (XPS). In addition, the catalyst has a pore volume of from 0.2 to 0.5 $cm^3/gr$, a specific surface of from 50 to 180 $m^2/gr$, a bimodal pore distribution such that 20% of pores are between 10 and 100 Å, and 60% between 100 and 1000 Å, with a particle size of from 0.5 to 3 mm. In accordance with a particular feature of the present invention the fixed bed upstream flow reactor is designed so as to permit the catalyst to be charged through the top of the reactor via line 16 and removed from the bottom of the reactor through line 18.

The substantially catalyst free liquid and gas effluents from the hydrodemetallization zone 14 is removed via line 20 and fed to a thermocracking zone 22 which comprises a high temperature down flow coil type reactor which operates without any catalyst or additives at a temperature of from 360° to 480° C., a pressure of from 120 to 230 atm, a space velocity of from 0.5 to 6.0 l/hr and a hydrogen-hydrocarbon ratio of from 300 to 5000 Nlt/lt. The product of the thermocracking zone is fed via line 24 to a hydrocarbon conversion zone 26 wherein the thermocracking zone product is contacted with hydrogen and a catalyst capable of cracking molecules of high cracking resistance. In accordance with the present invention the hydroconversion zone operates at a temperature of from 400° to 460° C., a pressure of from 120 to 230 atm, a space velocity of from 0.1 to 1.0 l/hr and a hydrogen-hydrocarbon ratio of from 300 to 5000 Nlt/lt. The catalyst employed in the hydrocarbon conversion zone has a molybdenum surface concentration of from 1.0 to 3.7% by weight, a titanium surface concentration of from 0.15 to 5.0% by weight, an iron surface concentration of from 6.0 to 20.0% by weight, a nickel surface concentration of from 0.3 to 8.0% by weight, an aluminum surface concentration of from 1.0 to 20.0% by weight, a magnesium surface concentration of from 2.0 to 25.0% by weight, and a sulfur surface concentration of from 7.0 to 28.0% by weight, as measured by photo-electron spectroscopy (XPS). In addition, the hydroconversion zone catalyst has a pore volume of from 0.2 to 0.6 $cm^3/gr$, a specific surface of from 30 to 150 $m^2/gr$, a bimodal pore distribution such that 40% of pores is between 10 and 100 Å, and 40% between 100 and 1000 Å, with a particle size of from 0.5 to 3 mm. As was the case with the hydrodemetallization zone 14 with hydrocarbon conversion zone 26 is fed with catalyst via line 28 from the top of the reactor and spent catalyst is removed via line 30 from the bottom of the reactor. Furthermore, in accordance with the features of the present invention, the reactor employed in the hydrocarbon conversion zone comprises, once again, an upstream flow fixed bed reactor. The product of the hydrocarbon conversion zone is then removed via line 32. It has been found that when processing the heavy hydrocarbon feedstocks set forth above by the process of the present invention the residue conversion of 500° C. obtained is higher than 60%, asphaltene conversion is higher than 50%, and Conradson Carbon conversion is higher than 40%, with hydrogenation being higher than 30%, metals removal and charge higher than 80% for a period of more than six months, and consumption of both catalysts lower than 0.3 Kg per processed barrel.

In accordance with the process of the present invention, the object of the first hydrodemetallization step is to remove large amounts of the feeding contaminants from the feedstock while the thermocracking stage and hydroconversion stage deal with the thermal and catalytical conversion of the high boiling point molecules of the feedstock into lower molecular weight higher reactivity molecules. By removing large amounts of contaminants from the feedstock in the first hydrodemetallization stage, the hydrocracking catalyst in the hydrocarbon conversion stage is protected in that there is low metal pick-up by the catalyst in the hydrocarbon conversion stage thereby increase its life expectancy. Due to the low reactivity of the feedstock, it is necessary to use a specific demetallization catalyst in the hydrodemetallization stage of the process as use of known prior art demetallization catalysts with the particular feedstock employed in the process of the present invention would result in premature aging of the catalyst caused by coke and metals being deposited on the surface of the catalyst during hydrodemetallization. Thus, the catalyst employed in the hydrodemetallization step must be capable of demetallizing organometallic complexes of high molecular weight and cracking resistance; therefore, the physical and chemical properties of the catalyst must allow it to crack the feedstock while at the same time demetallize. The catalyst employed in the hydrodemetallization zone in accordance with the present invention is set forth above. In accordance with the particular features of the present invention, the catalyst of the third hydrocarbon conversion stage must be capable of cracking molecules of high cracking resistance and of accumulating metals. The hydrocarbon conversion zone catalyst in accordance with the present invention is set forth above.

The advantages of the process of the present invention will be made clear from the following examples.

EXAMPLE 1

Two experiments were conducted by using a TIA JUANA heavy short residue and a hydrodemetallization catalyst in accordance with the present invention in hydrodemetallization zone 14 operating at a temperature of 410° C., a pressure of 1800 psig and a space velocity of 1.0 l/hr., operating first with an upstream flow and then with a downstream flow, both with fresh catalyst. The surface and bulk properties of the hydrodemetallization catalyst are set forth in Table 7 and Table 8, respectively. Feedstock and product properties for both experiments are shown in Table 1.

Table 1 clearly shows that there is a pronounced difference between the upstream flow and downstream flow operation modes. Increase in gravity API, desulfurization, demetallization and residue conversion of 540° C.+ residue and Conradson carbon reduction are higher for the upstream flow. The Conradson carbon reduction indicates a lower carbon creation during hydrodemetallization.

TABLE 1

| FEEDSTOCK AND PRODUCT PROPERTIES | | | |
|---|---|---|---|
| PROPERTY | FEEDSTOCK | PRODUCT 1 Upstream Flow | PRODUCT 2 Downstream Flow |
| API | 2.0 | 12.1 | 9.88 |
| SULFUR | 3.2 | 1.78 | 2.21 |
| VANADIUM | 590. | 399. | 407. |
| VISC 210 (cSt) | 30000. | 144. | 201. |
| CONRADSON CARBON | 21.8 | 17.5 | 18.6 |
| ASPHALTENES | 13.8 | 13.2 | 12.7 |
| RESIDUE 540° C.+ | 88.2 | 42.0 | 70.5 |

EXAMPLE 2

A TIA JUANA heavy short residue was processed in accordance with Example 1 operating with upstream flow and the demetallized product was fed directly to a hydroconversion zone 26 having a hydroconversion catalyst of the present invention having the properties set forth in Tables 7 and 8. The hydroconversion zone was operated at a temperature of 410° C., a pressure of 1800 psig and a space velocity of 0.6 l/hr., operating first with an upstream flow and then with a downstream flow, both with fresh catalyst. The demetallized feedstock to the hydroconversion zone and product properties for both experiments are shown in Table 2.

Table 2 clearly shows a pronounced difference between both operation modes. Increase in gravity API, viscoreduction, demetallization and residue conversion of 540° C.+ are higher for the upstream flow.

TABLE 2

| PROPERTY | DEMETALLIZED FEEDSTOCK | PRODUCT 1 Upstream Flow | PRODUCT 2 Downstream Flow |
|---|---|---|---|
| API | 10.4 | 13.5 | 10.2 |
| SULFUR | 2.1 | 1.3 | 1.5 |
| VANADIUM | 326 | 202 | 220 |
| VISC 210 (cSt) | 341 | 203 | 237 |
| CONRADSON CARBON | 19.9 | 12.6 | 14.0 |
| ASPHALTENES | 15.6 | 10.5 | 14.0 |
| RESIDUE 540° C.+ | 74.8 | 43. | 50 |

EXAMPLE 3

An experiment was conducted using an already demetallized TIA JUANA heavy short residue processed in accordance with upstream flow in Example 1. The experiment was divided into two stages in order to demonstrate that an upstream mode flow was superior to downstream mode even when the hydroconversion catalyst of the present invention (see Tables 7 and 8) was slightly deactivated from previous use. A hydroconversion zone was charged with the hydroconversion catalyst of the present invention and the demetallized feedstock of Table 3 was fed therethrough under the following operating conditions: temperature of 410° C., a pressure of 1800 psig and a space velocity of 1.0 l/hr. In Stage I the reactor was operated in the downstream mode for the first day, upstream mode on the second day and downstream mode for the third day. The products for days one, two and three are shown in Table 3.

TABLE 3

| CHARGE AND PRODUCT PROPERTIES STAGE I | | | | |
|---|---|---|---|---|
| Property | DEMETALLIZED FEEDSTOCK | Downstream Product 1 | Upstream Product 2 | Downstream Product 3 |
| API | 8.2 | 9.0 | 9.1 | 9.2 |
| Sulfur (% wt) | 2.4 | 1.9 | 2.0 | 2.1 |
| Vanadium (ppm) | 309. | 262. | 266. | 280. |
| Visc 210 (cst) | 341. | 257. | 266. | 260. |
| Conradson Carbon | 18.8 | 18.1 | 18.3 | 18.4 |
| Asphaltenes | 13.4 | 12.1 | 12.3 | 12.2 |
| Residue 540° C.+ | 68.8 | 63.0 | 61.5 | 67.0 |

No significant differences were observed between both operation modes. Increase in residue conversion 540° C.+ is substantially higher for the upstream flow.

In Stage II the reactor was operated for thirty days in the upstream mode. After thirty days the reactor was operated in the downstream mode for one day and thereafter the upstream mode for one day. The product properties for Stage II are set forth in Table 4.

TABLE 4

| PRODUCT PROPERTIES STAGE II | | |
|---|---|---|
| Property | Downstream Product 1 | Upstream Product 2 |
| API | 10.0 | 10.8 |
| Sulfur (% wt) | 1.8 | 1.8 |
| Vanadium (ppm) | 266. | 224. |
| Visc 210 (cst) | 184. | 115. |
| Conradson Carbon | 17.5 | 17.3 |
| Asphaltenes | 11.9 | 11.9 |
| Residue 540° C.+ | 63.8 | 59. |

As it may be seen from Table 4, in spite of catalyst being slightly deactivated, the upstream product is of a higher quality than the downstream product.

EXAMPLE 4

An experiment was conducted using an already demetallized TIA JUANA heavy short residue processed in accordance with Example 1 in upstream flow. The experiment was designed to show that the conversion of fraction 1 (GPC) is greater in the upstream mode of operation. The feedstock was treated in a hydroconversion zone with the hydroconversion catalyst of the present invention operating at a temperature of 425° C., a pressure of 1800 psig, and a space velocity of 0.8 l/hr., operating first with a downstream flow, and then with an upstream flow, without changing catalyst.

Figure 3:
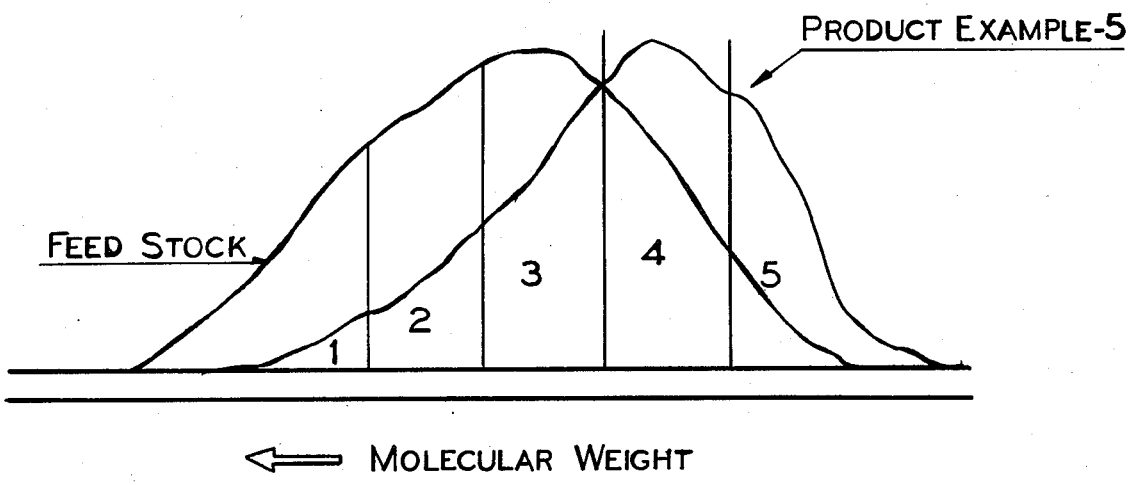
FIG. 3 is a graph illustrating the molecular weight distribution of five different cuts of product 2 of Example 5.

The activity levels of the experiment are shown in Table 5. There is a big difference in activity between the operation modes. Gravity, API, viscoreduction, demetallization, and residue conversion 540° C.+ were higher in the upstream flow. Most importantly the conversion of fraction 1 is greater in the upstream flow. FIG. 3 shows the molecular weight distribution for Product 2.

TABLE 5

CHARGE AND PRODUCT PROPERTIES

| Activity | Downstream Product 1 | Upstream Product 2 |
|---|---|---|
| Delta API | 36.6 | 57.3 |
| HDS (%) | 31.2 | 37.3 |
| HDM (%) | 34. | 40.5 |
| Viscoreduction | 76. | 85. |
| Delta Conradson Carbon | 8.3 | 15.5 |
| Asphaltene Conversion | 16.4 | 29.5 |
| Residue Conversion 540° C.+ (%) | 42 | 55 |
| Conversion of Fraction 1, wt. % | 20 | 35 |

EXAMPLE 5

Two experiments were conducted for comparison purposes. In the first one, a known hydrotreatment catalyst of the Cyanamid Ni—Mo type was used in both the hydrodemetallization and hydroconversion stages. In the second one, the hydrodemetallization catalyst of the present invention was used in the hydrodemetallization zone and a hydroconversion catalyst of the type of the present invention in the hydroconversion zone. Operation conditions were similar in both experiments; for HDM: 400° C., 1800 psig, 0.3 LHSV; HC: 420° C., 1800 psig, 0.3 LHSV. No thermal cracking was employed between stages.

The activity levels of both experiments are shown in Table 6. It will be seen that using the combination of catalysts of the present invention there is a big difference in terms of increases in gravity API, desulfurization, demetallization, and residue conversion 540° C.+ prove to be higher.

TABLE 6

ACTIVITY LEVELS OF EXPERIMENTS

| Activity | Experiment 1 Cyanamid Ni—Mo | Experiment 2 LHC-1/INT R-7 |
|---|---|---|
| Delta API | 6.5 | 21.9 |
| HDS (%) | 74.9 | 81.4 |
| HDM (%) | 84.0 | 94.6 |
| CCR Conversion (%) | 42.0 | — |
| Residue Conversion 500° C.+ (%) | 77.6 | 80.0 |

The properties of the catalysts employed in Experiments 1 and 2 are set forth below in Tables 7 and 8.

TABLE 7

XPS SURFACE COMPOSITION

| $I_{Me}/I_{\Delta 1} + I_{Me}$ | Cyanamid | Hydrodemetallization INT R-7 | Hydroconversion LHC-1 |
|---|---|---|---|
| $I_{Mo}/I_{\Delta 1} + Me$ | 3.0 | 6.2 | 2.14 |
| $I_{Ni}/I_{\Delta 1} + Me$ | — | 3.5 | 2.47 |

TABLE 7-continued

XPS SURFACE COMPOSITION

| $I_{Me}/I_{\Delta 1} + I_{Me}$ | Cyanamid | Hydrodemetallization INT R-7 | Hydroconversion LHC-1 |
|---|---|---|---|
| $I_{Co}/I_{\Delta 1} + Me$ | 4.1 | — | — |
| $I_{Fe}/I_{\Delta 1} + Me$ | — | — | 10.24 |
| $I_{Ti}/I_{\Delta 1} + Me$ | — | 0.5 | 3.2 |
| $I_{Mg}/I_{\Delta 1} + Me$ | — | — | 20.7 |
| $I_S/I_{\Delta 1} + Me$ | 2.7 | 4.2 | 7.5 |

TABLE 8

CATALYST COMPOSITION

| | Cyanamid | Hydroconversion LHC-1 | Hydrodemetallization INT R-7 |
|---|---|---|---|
| % MoO3 | 16.0 | 4.0 | 8.10 |
| % NiO | — | 3.0 | 1.13 |
| % CoO | 3.8 | — | — |
| % $TiO_2$ | — | 1.3 | 0.15 |
| Support | $Al_2O_3$ | Laterite | $Al_2O_3$ |
| Particle Size (Inch.) | 1/16 | 1/32 | 1/32 |
| Bet Area ($m^2/g$) | 200 | 62 | 177 |
| Pore Volume (cc/g) | 0.65 | 0.3 | 0.67 |
| Average Pore Diameter (Å) | 120 | 331 | 151 |
| Real Density (g/cc) | 3.50 | 2.21 | 4.77 |
| Apparent Density (g/cc) | 1.48 | 1.36 | 1.1 |
| Bed Density (g/cc) | 0.62 | 0.98 | 0.58 |
| Bed Resistance (Kg/mm) | 8.3 | 8.0 | 5.7 |
| Pore Distribution Diameter (Å) | | | |
| 20–30 | 4.3 | 10.5 | 5.4 |
| 30–60 | 8.6 | 10.5 | 10.41 |
| 60–90 | 19.9 | 18.1 | 13.81 |
| 90–150 | 23.7 | 22.5 | 23.82 |
| 150–300 | 19.4 | 14.0 | 28.82 |
| 300–10E3 | 4.6 | 7.2 | 5.41 |
| 10E3 | 1.7 | 16.5 | 6.31 |

EXAMPLE 6

Figure 2:
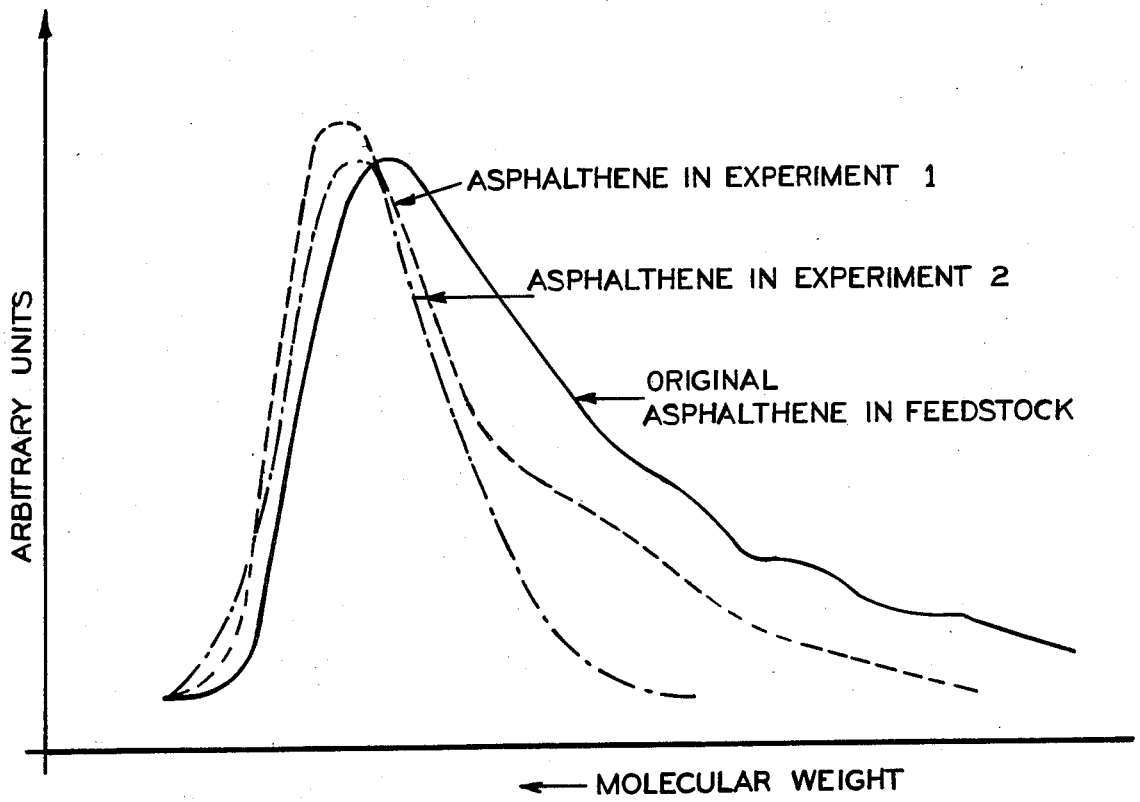
FIG. 2 is a graph showing the molecular weight distribution of asphaltenes for the products of Example 6.

An experiment was conducted employing the catalyst of the present invention as set forth in Example 5, wherein no heat stage was applied between hydrodemetallization and hydroconversion and a heat stage was applied between hydrodemetallization and hydroconversion. Table 9 shows the relevance of the stage within the overall process. When the heat stage is applied increases in gravity API, demetallization, and residue conversion 540° C.+ are higher. FIG. 2 shows molecular weight distribution for asphaltenes in both products. The molecular weight of products fraction are considerably reduced during the heat stage.

TABLE 9

ACTIVITY LEVELS OF EXPERIMENT

Experimental conditions for Example 6 (HDM: 400° C., 1800 psig 0.3 $h^{-1}$; HCK: 420° C., 1800 psig 0.3 $h^{-1}$).

| Activity | Experiment 1 No Heat Stage | Experiment 2 Heat Stage (445° C.) |
|---|---|---|
| Delta API | 6.8 | 10.5 |
| HDS (%) | 75.1 | 82.8 |
| HDM (%) | 84.5 | 92.0 |
| Delta Conradson Carbon | 42.9 | 54.5 |
| Asphaltene Conversion (%) | 45.1 | 49.2 |
| Residue Conversion 540° C.+ (%) | 77.6 | 82.5 |

EXAMPLE 7

An experiment identical to Experiment 2 of Example 6 was run however a commercial Cyanamid Catalyst was employed instead of the catalyst of the present invention using the intermediate hydrothermal stage and up flow reactors as described in Example 5. The results with this system were:

TABLE 10

| HEAT STAGE AT 445° C. | |
|---|---|
| Activity | |
| Delta API | 3.2 |
| HDS % | 79 |
| HDM % | 85 |
| Delta CCR % wt. | 48.0 |
| Delta Asphaltene % wt | 42.0 |
| Residue Conversion (540° C.+ % W) | 73.2 |

The results indicate that even with non appropriate catalytic system but using upflow reactor and intermediate hydrothermal stage the activities for sulfur, carbon conradson, asphaltene and residue conversion are improved.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the conversion of a heavy hydrocarbon feedstock characterized by high molecular weight, low reactivity and high metal contents comprising:

(a) feeding said heavy hydrocarbon feedstock characterized by the following composition and properties:

| | |
|---|---|
| Gravity, °API | 0–15 |
| KV at 210° F., cst | 5000–70,000 |
| Vanadium, wt. ppm | 400–800 |
| Nickel, wt. ppm | 50–150 |
| Asphaltenes, % wt. | 10–25 |
| Conradson Carbon, % wt. | 10 |
| 500° C. + Residue Content, % wt. | 50% |

to a hydrodemetallization zone wherein said feedstock is contacted with hydrogen and a catalyst capable of demetallizing organometallic complexes of high molecular weight and cracking resistance, said catalyst having the following composition and properties: a molybdenum surface concentration of from 4.0 to 8.0% by weight, a titanium surface concentration of from 0.15 to 1.2% by weight, a nickel surface concentration of from 2.0 to 5.0% by weight, an aluminum surface concentration of from 50.0 to 80.0% by weight and a sulfur surface concentration of from 2 to 10%, as measured by photoelectron spectroscopy (XPS) and a pore volume of from 0.2 to 0.5 $cm^3/gr$, a specific surface of from 50 to 180 $m^2/gr$, a bimodal pore distribution such that 20% of pores is between 10 and 100 Å, and 60% between 100 and 1000 Å, with a particle size of from 0.5 to 3 mm so as to produce an effluent;

(b) removing the effluent from said demetallization zone and feeding said effluent to a thermal cracking zone wherein said effluent is contacted with hydrogen so as to produce a cracked product; and (c) feeding the cracked product of said cracking zone to a hydrocarbon conversion zone wherein said product is contacted with hydrogen and a catalyst capable of cracking molecules of high cracking resistance, said catalyst having the following composition and properties: a molybdenum surface concentration of from 1.0 to 3.7% by weight, a titanium surface concentration of from 0.15 to 5.0% by weight, an iron surface concentration of from 6.0 to 20.0% by weight, a nickel surface concentration of from 0.3 to 8.0% by weight, an aluminum surface concentration of from 1 to 20% by weight, a magnesium surface concentration of from 2.0 to 25.0% by weight, and a sulfur surface concentration of from 7.0 to 28.0% by weight, as measured by photo-electron spectroscopy (XPS) and a pore volume of from 0.2 to 0.6 $cm^3/gr$, a specific surface of from 30 to 150 $m^2/gr$, a bimodal pore distribution such that 40% of pores is between 10 and 100 Å, and 40% between 100 and 1000 Å, with a particle size of from 0.5 to 3 mm.

2. A process according to claim 1 wherein said hydrodemetallization zone operates at a temperature of from 380° to 440° C., a pressure of from 120 to 230 atm, a space velocity of from 0.1 to 1.0 l/hr and a hydrogen-hydrocarbon ratio of from 300 to 5000 Nlt/lt.

3. A process according to claim 2 wherein said thermal cracking zone operates at a temperature of from 360° to 480° C., a pressure of from 120 to 230 atm, a space velocity of from 0.1 to 6.0 l/hr and a hydrogen-hydrocarbon ratio of from 300 to 5000 Nlt/lt.

4. A process according to claim 3 wherein said hydrocarbon conversion zone operates at a temperature of from 400° to 460° C., a pressure of from 120 to 230 atm, a space velocity of from 0.1 to 1.0 l/hr and a hydrogen-hydrocarbon ratio of from 300 to 5000 Nlt/lt.

5. A process according to claim 1 wherein the reactors used in the first and third zones operate with an upstream flow.

6. A process according to claim 5 wherein the reactor used in the second zone operates with a downstream flow and no catalyst.

7. A process according to claim 1 wherein said 500° C.+ residue has a low reactivity characterized by a molecular weight distribution from 1000 to 100,000 as measured by gel chromatography at room temperature and a pressure from 2 to 10 atm, wherein 40% by weight of the vanadium distribution of said residue is concentrated in the fraction having a molecular weight from 10,000 to 100,000.

* * * * *